US006145411A

United States Patent [19]

Chen

[11] Patent Number: 6,145,411

[45] Date of Patent: Nov. 14, 2000

[54] STRUCTURE IMPROVEMENT OF CORK BOTTLE OPENER

[76] Inventor: Kun-Yang Chen, No. 292, Cheng Tu Road, Taichung, Taiwan

[21] Appl. No.: 09/383,378

[22] Filed: Aug. 26, 1999

[51] Int. Cl.[7] ..... B67B 7/18

[52] U.S. Cl. ..... 81/3.29; 81/3.45

[58] Field of Search ..... 81/3.29, 3.35, 81/3.36, 3.37, 3.45, 3.09

[56] References Cited

U.S. PATENT DOCUMENTS

| | | | |
|---|---|---|---|
| 181,147 | 8/1876 | Decker | 81/3.29 |
| 445,539 | 2/1891 | Campbell et al. | 81/3.29 |
| 4,570,512 | 2/1986 | Pracht | 81/3.29 |
| 4,727,779 | 3/1988 | Lee | 81/3.37 |
| 5,086,675 | 2/1992 | Leung et al. | 81/3.29 |
| 5,257,565 | 11/1993 | Hung | 81/3.29 |
| 5,361,652 | 11/1994 | Andina | 81/3.29 |
| 5,724,869 | 3/1998 | May | 81/3.2 |

*Primary Examiner*—Timothy V. Eley
*Assistant Examiner*—Dung Van Nguyen

[57] ABSTRACT

The invention discloses the structural improvement of a cork bottle opener. It is composed of a hollow cylinder, moving block and central rod. There is a cover locked at the top end of said hollow cylinder. And there is a section of inner thread in the inner wall of top end. The other end is combination end. A snap groove is set at the center of said moving block. The outer edge of said moving block has outer thread, which can be screwed to inner thread of hollow cylinder. The central rod penetrates to the hollow cylinder through a central hole on the cover. A handle is set at one end of said central rod, and a screw drill is set at another end. A constraint flange is set at the middle of central rod. A wedge is set at the end of constraint flange adjacent to screw drill. The wedge can be snapped to snap groove of moving block. The face of said constraint flange adjacent to wedge is jacked to the face of moving block, so that the central rod can be moved up and down associated with moving block, the moving block can be slipped to the fixed position.

9 Claims, 7 Drawing Sheets

STRUCTURE IMPROVEMENT OF CORK BOTTLE OPENER

BACKGROUND OF THE INVENTION

The invention relates to a cork bottle opener. A hollow cylinder with a section of inner thread in the inner wall of one end is used. When the handle is rotated, the central rod can move moving block up and down in the hollow cylinder, which is able to pull cork out, in order to provide structural improvement of cork bottle opener with single hand operation, force saving and safety features.

At present, the conventional cork bottle opener is shown in FIGS. 1 and 2. As for its operation, the handle (3) is rotated; the screw drill (2) will be drilled into cork. Now, the groove (4) on the edge of central rod (1) is wedged to gear disc (5) on the top end of handle (3). So, when the screw drill (2) is drilled down, the handle (3) will be opened due to gear disc (5) rotation. Then press the handle (3) down with both hands, the central rod (1) will pull cork upward. But due to both hands are used; the bottle can not be grasped fixedly. If the force applied is uneven, the bottle might slip to the ground to break. Or the hand might get hurt due to abnormal operation. Or the screw drill might drill through cork, and cork debris drops in bottle. So, it is very inconvenient.

The inventor discloses this practical and innovating invention based on his abundant experience on research, development, and sales of related products.

SUMMARY OF THE PRESENT INVENTION

The present invention has a main object is to provide a structural improvement of cork bottle opener, which the operation is easy, force saving and safe, which is very convenient for the user.

Accordingly, the present invention is a structural improvement of cork bottle opener, which comprises a cylinder, a moving block and a central rod, a section of inner thread in the inner wall of top end, the other end is bottle mouth combination end. The outer edge of moving block has outer thread which can be screwed to inner thread of cylinder, a snap groove is non-circle, a cover is set on the cylinder, a central hole on the cover, the central rod penetrates through the cylinder, a handle is set at one end of said central rod, and a screw drill is set at another end, a wedge is set at the middle of central rod, the wedge can be snapped to snap groove of moving block, a constraint flange is set adjacent to the wedge on said central rod, the face of said constraint flange adjacent to wedge is jacked to the face of moving block, so the moving block can be slipped to fixed position.

DETAILED DESCRIPTION OF THE PREFERRED EMBODIMENTS

Figure 1:
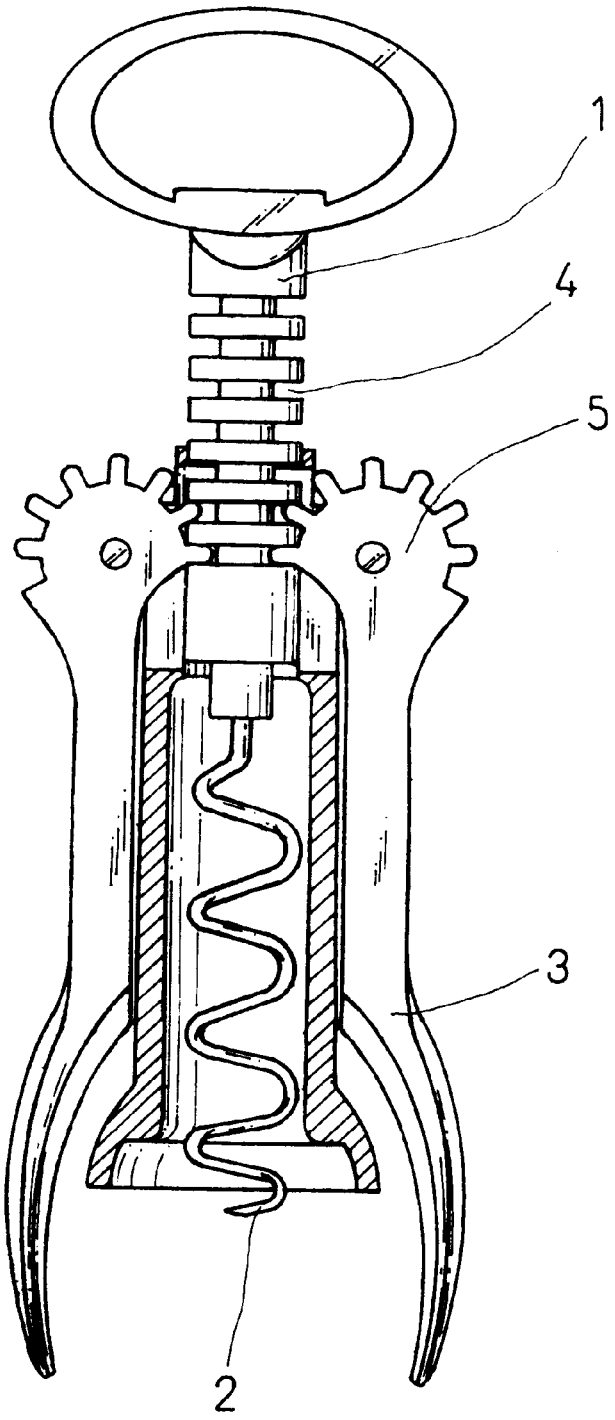
PRIOR ART FIG. 1
FIG. 1 is a side view to show the application of conventional cork bottle opener.
Figure 2:
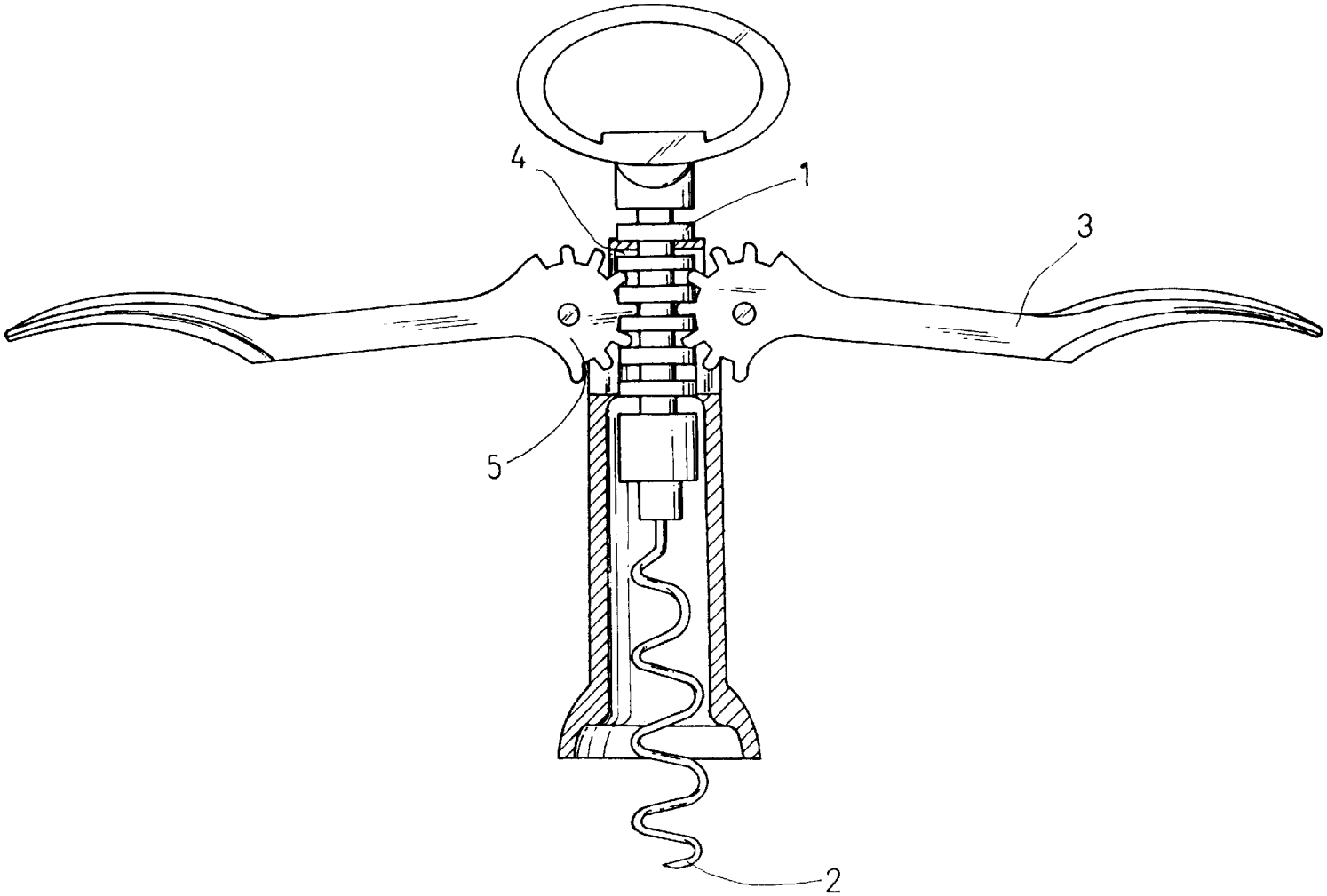
PRIOR ART FIG. 2
FIG. 2 is a side view to show the conventional cork bottle opener during operation.
Figure 3:
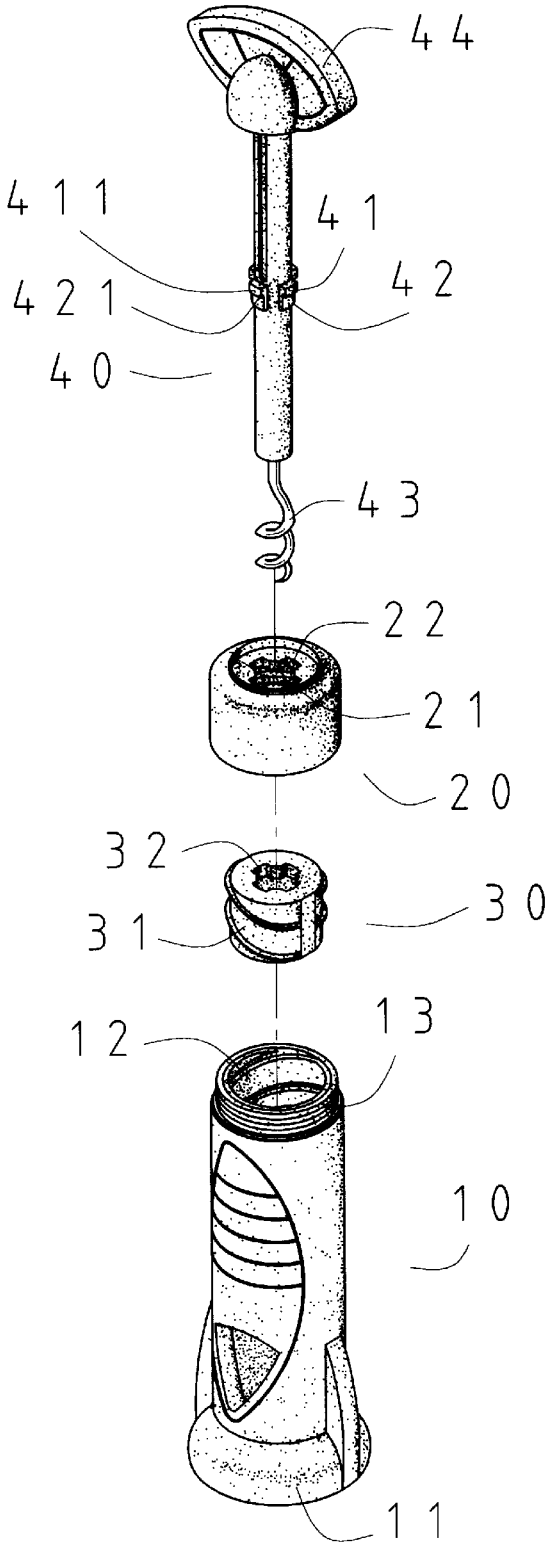
FIG. 3 is an isometric view to show the preferred embodiment of the present invention in exploded form.
Figure 4:
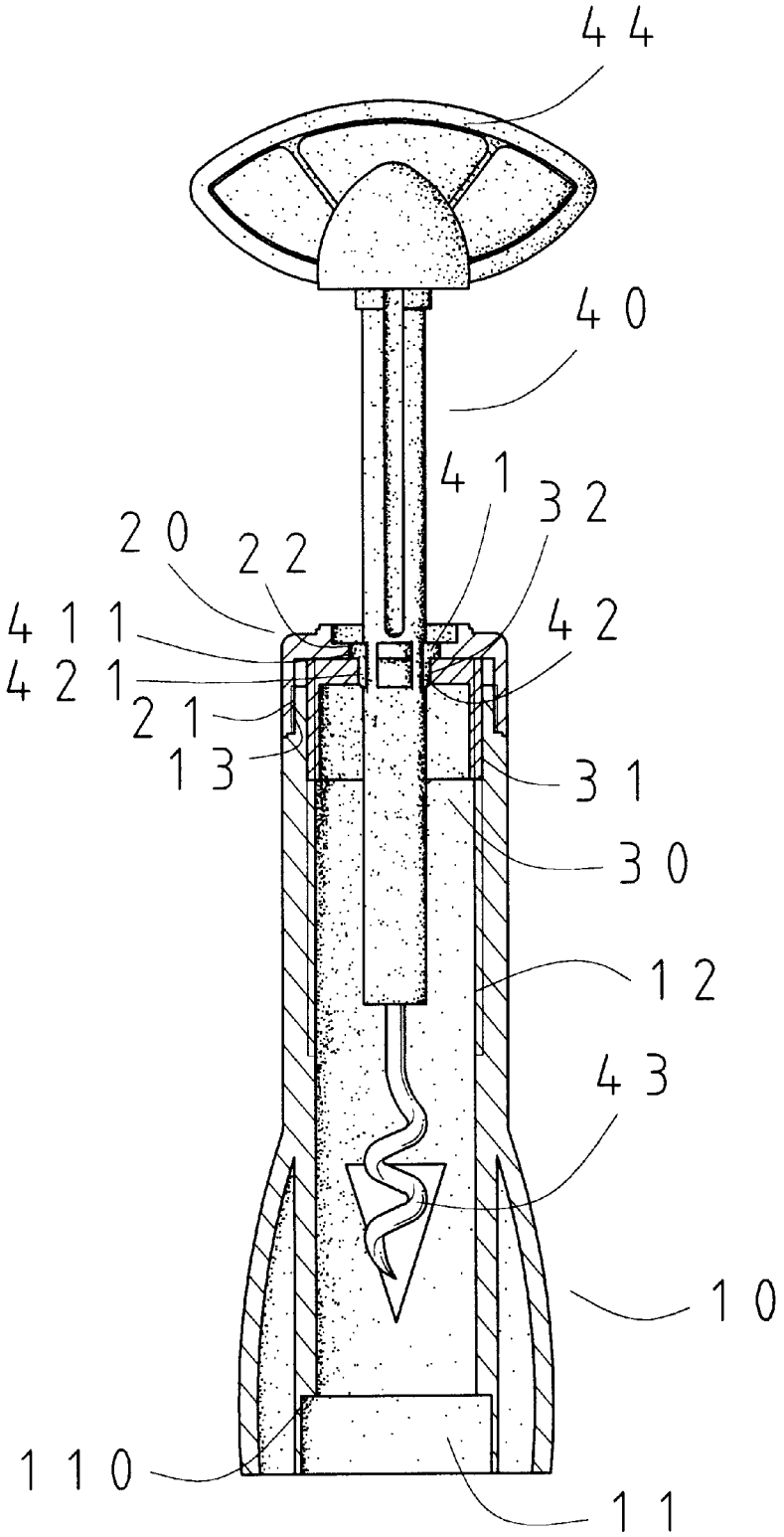
FIG. 4 is a side view to show the preferred embodiment of the present invention.

Please refer to FIGS. 3 and 4, which show some preferred embodiments of the invention. It mainly comprises a hollow cylinder 10. One end is bottle mouth combination end 11. A contact edge 110 is set in inner wall of said combination end 11, which is used to fix top end of bottle mouth 50. The thread 13 is set on the outer edge of cylinder 10 at another end, which locks a cover 20 with inner thread 21 in the inner edge. There is a hole 22 at the center of said cover 20, and a central rod 40 penetrates through the hole 22. A section of inner thread 12 is set at the inner wall of cylinder 10 adjacent to cover 20, which can be used to screw a moving block 30 with outer thread 31 on the outer edge, so that the moving block 30 can be moved up and down in the cylinder 10. A snap groove 32 is set at the center of said moving block 30. A central rod 40 penetrates through cylinder 10. A handle 44 is set at one end of said central rod 40, and a screw drill 43 is set at another end. A wedge 42 is set at the middle of said central rod 40, which can be used to snap into snap groove 32. The wedge 42 is composed of several flanges 421 which is surrounded on outer edge of central rod 40. A constraint flange 41 is set on central rod 40 adjacent to the wedge 42 and handle 44. The thrust flange 411 is extended from the flange 421 to form said constraint flange 41 adjacent to the handle 44. The radial length of said thrust flange 411 is longer than that of flange 421. The face of said constraint flange 41 adjacent to wedge 42 is jacked to the face of moving block 30, so that central rod 40 can be moved associated with moving block 30.

Furthermore, the handle 44 has elliptic shape, so that it is easy to be rotated.

Besides, the stroke of inner thread 12 of inner wall in the cylinder 10 is larger, so that the cork 60 can be pull out quickly with less force and time.

For the assembly of this invention, the outer thread 31 of moving block 30 is screwed to inner thread 12 of cylinder 10, so that the moving block 30 can be fixed in cylinder 10. The cover 20 is locked to thread 13 at outer edge of cylinder 10. The central rod 40 penetrates from the central hole 22 of cover 20 into cylinder 10. The wedge 42 at middle part of central rod 40 can be snapped to snap groove 32 of moving block 30, the face of said constraint flange 41 adjacent to wedge 42 is jacked to the face of moving block 30 (as shown in FIG. 4).

Figure 5:
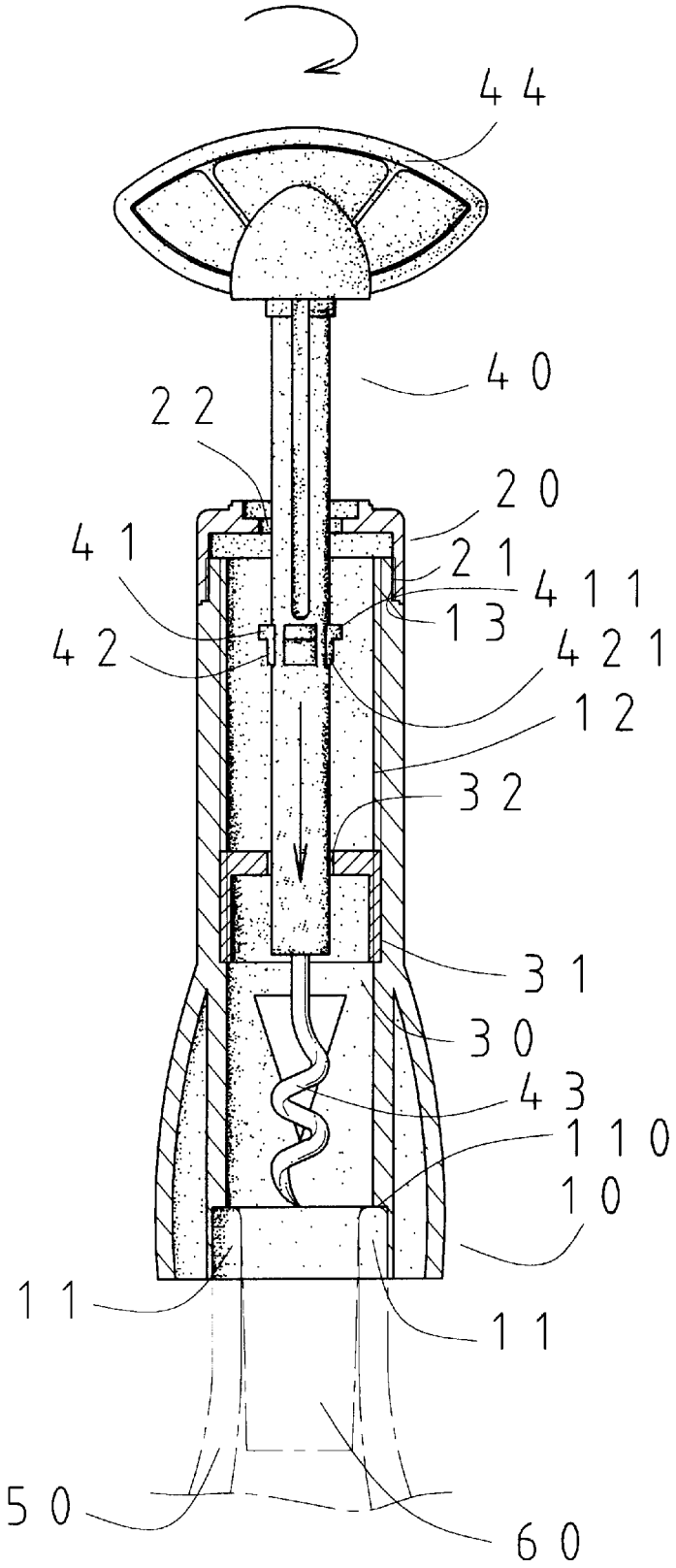
FIG. 5 shows the operation 1 of the preferred embodiment of the present invention.
Figure 6:
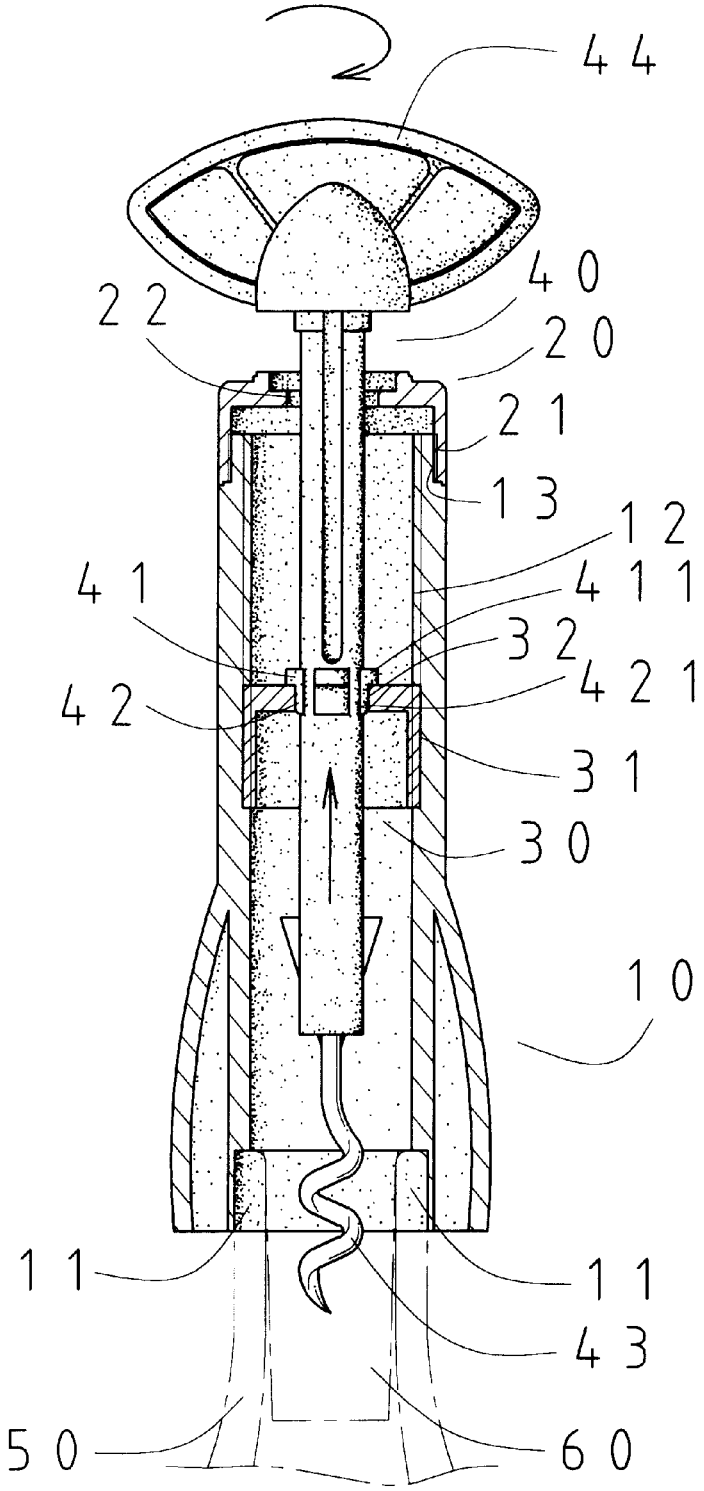
FIG. 6 shows the operation 2 of the preferred embodiment of the present invention.
Figure 7:
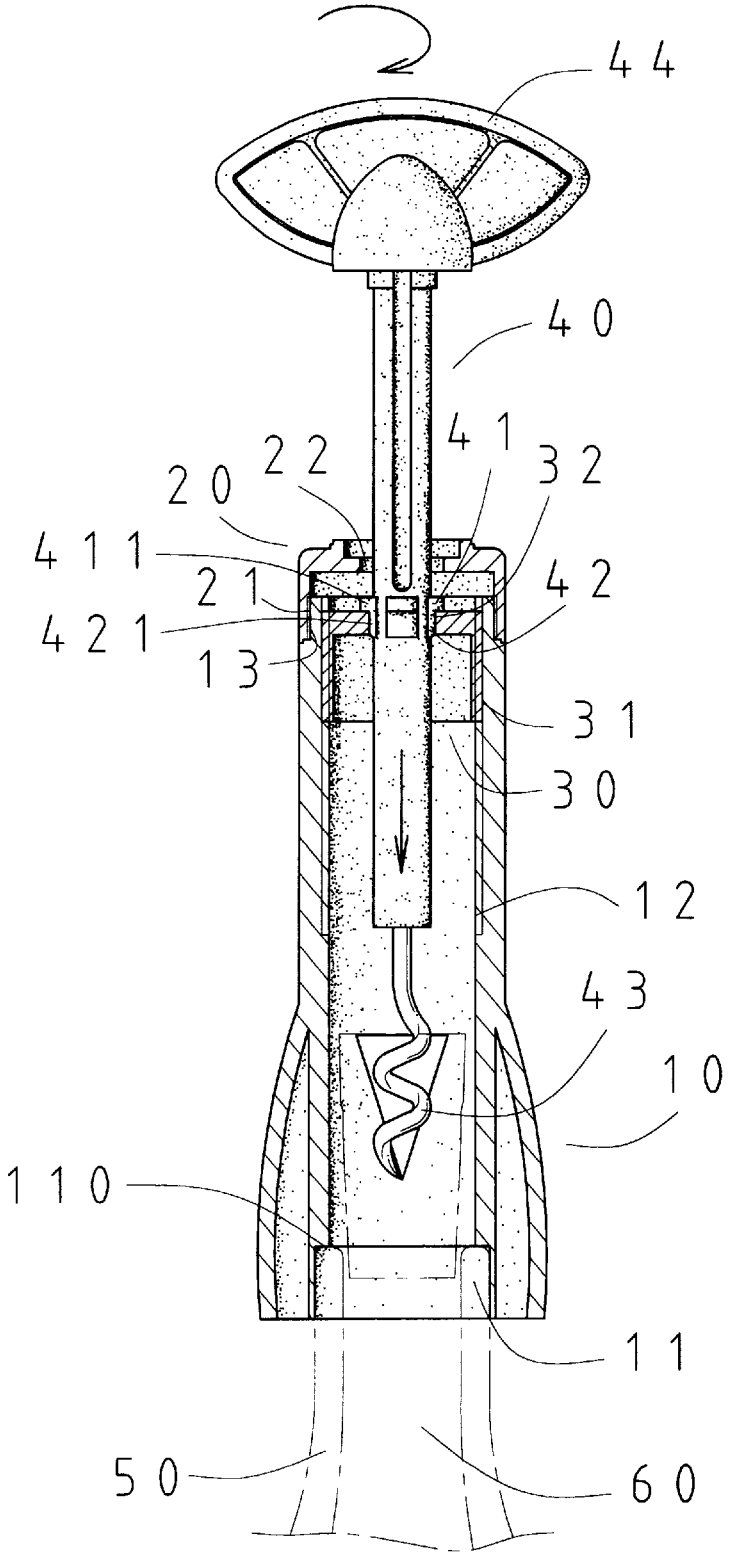
FIG. 7 shows the operation 3 of the preferred embodiment of the present invention.

Please refer to FIG. 5. When you want to pull out the cork 60 in bottle mouth 50, put the combination end 11 on bottle mouth 50, so that the contact edge 110 of inner wall is located at top end of bottle mouth 50. Now, the cork 60 in bottle mouth 50 will jack central rod 40 up, and the screw drill 43 of central rod 40 will contact to the face of cork 60, and the wedge 41 is separated from snap groove 32. Rotate the handle 44 clockwise, the screw drill 43 will drill into cork 60. When the wedge 42 is snapped to snap groove 32 of moving block 30, the constraint flange 41 adjacent to wedge 42 is jacked to the face of moving block 30, and the central rod 40 can not go further (see FIG. 6). The screw drill 43 can only be drilled to a fix point in cork 60 without penetrating through cork 60. So the cork 60 debris will not drop into bottle. Rotate the handle 44 continuously, the central rod 40 will rotate moving block 30. Because the outer thread 31 of moving block 30 is screwed to inner thread 12 of cylinder 10, so the moving block 30 will move up in cylinder 10. When the moving block 30 is moving up in cylinder 10, the moving block 30 will push the constraint flange 41 and bring central rod 40 up. The cork 60 in bottle mouth 50 will be pulled out (see FIG. 7).

Due to said structure and feature; the invention has the following advantages during actual operation:

1. When the cork is pulled out, only single hand is used, and the operation is easy, safe and force saving, which brings much convenience to the user.

2. During the operation, the screw drill will not drill through the cork in bottle mouth, so the cork debris will not drop into bottle to influence quality.

3. When the bottle mouth is put in open end of cylinder, the axial center of central rod will focus on central area of cork.

From the above description the present invention can satisfy the expected goal through innovating structure and whole special type. It has excellent industrial usages and meets the requirement of new patent. So, please review the application in detail and approve it earlier to give the convenience to applicant.

What is claimed is:

1. A structural improvement of cork bottle opener comprising:

a cylinder, a moving block and a central rod, a cover connected to one end of said cylinder and a section of thread defined in an inner wall of said cylinder, the other end of said cylinder being a bottle mouth combination end, an outer edge of said moving block having an outer thread which is screwed to said section of thread of said cylinder, a snap groove defined through a center of aid moving block, a cross-section of said snap groove being non-circle, a hole defined in a central part of said cover, said central rod movably penetrating through said hole in said cover and said snap groove in said moving block, a handle connected to one end of said central rod and a screw drill connected to the other end of said central rod, a wedge connected to a middle of said central rod disengagably snapped to said snap groove of said moving block, a constraint flange connected adjacent to said wedge on said central rod.

2. A cork bottle opener according to claim 1, wherein the wedge is composed of several flanges which surround the outer edge of the central rod.

3. A cork bottle opener according to claim 2, wherein the wedge has four flanges.

4. A cork bottle opener according to claim 1, wherein the constraint flange is composed of several flanges which surround the outer edge of central rod.

5. A cork bottle opener according to claim 1, wherein the constraint flange possesses a thrust flange for each flange.

6. A cork bottle opener according to claim 5, wherein the radial length of said constraint flange is longer than that of the wedge.

7. A cork bottle opener according to claim 1, wherein a touch edge is set at the inner wall of the bottle mouth combination end, the touch edge being used to fix the top end of bottle mouth.

8. A cork bottle opener according to claim 1, wherein the handle has an elliptic shape.

9. A cork bottle opener according to claim 1, wherein the outer thread is set at one end of the cylinder, so that the cover can be locked onto it.

* * * * *